United States Patent [19]

Takeuchi et al.

[11] 4,452,137

[45] Jun. 5, 1984

[54] SMALL-SIZED PRINTER

[75] Inventors: Shin Takeuchi; Kenji Onodera, both of Shiojiri, Japan

[73] Assignees: Epson Corporation, Nagano; Kabushiki Kaisha Suwa Seikosha, Tokyo, both of Japan

[21] Appl. No.: 407,860

[22] Filed: Aug. 13, 1982

[30] Foreign Application Priority Data

Aug. 18, 1981 [JP] Japan ..... 56-129520

[51] Int. Cl.[3] ..... B41J 1/52

[52] U.S. Cl. ..... 101/93.22; 101/93.28; 101/99; 101/110

[58] Field of Search ..... 101/99, 93.22, 93.09, 101/110, 93.21, 93.24, 93.28, 93.29, 93.35; 400/154.1, 155, 155.1

[56] References Cited

U.S. PATENT DOCUMENTS

| | | | |
|---|---|---|---|
| 3,884,144 | 5/1975 | Shimodaira | 101/110 X |
| 3,890,894 | 6/1975 | Nihira | 101/93.35 X |
| 3,916,786 | 11/1975 | Clary | 101/99 X |

FOREIGN PATENT DOCUMENTS

| | | | |
|---|---|---|---|
| 2095181 | 9/1982 | United Kingdom | 101/99 |

*Primary Examiner*—Edgar S. Burr
*Assistant Examiner*—Charles A. Pearson
*Attorney, Agent, or Firm*—Blum, Kaplan, Friedman, Silberman & Beran

[57] ABSTRACT

A printer for printing a row of characters on a recording medium. The printer includes at least first and second type rings having types disposed on the periphery thereof which are rotatable from a reset position to a print position. First and second pawls are associated with the first and second type rings, respectively. A control member moves the first pawl into engagement with the first type ring when in its reset position to prevent rotation thereof. The second type ring is rotated into a print position while the first type ring is held in its reset position by the first pawl. A lever associated with the first and second pawls is actuated by an electromagnet to move the second pawl into engagement with the second type ring when in a print position to stop the rotation thereof. The control member releases the first pawl from the first type ring which then rotates to a print position. The lever is then reactuated by the electromagnet to move the first pawl into engagement with the first type ring when in a print position. A positioning member positions the second pawl out of engagement with the second type ring and also acts to hold the second pawl in engagement with the second type ring when the second pawl is moved into engagement with the second type ring.

19 Claims, 4 Drawing Figures

SMALL-SIZED PRINTER

BACKGROUND OF THE INVENTION

The present invention relates generally to a printer having a plurality of selectable type rings or character wheels, and, in particular, to a small-sized printer having an improved type selection mechanism which controls at least two type rings by a lever actuated by an electromagnet.

Printers of the type under discussion having a plurality of type rings controlled by levers and electromagnets are disclosed in U.S. patent application Ser. No. 06/344,133, filed Jan. 29, 1982 assigned to the same assignees as the present application and Japanese laid-open patent publication No. 54-16228. In application Ser. No. 06/344,133, each type ring includes its own pawl lever, with two pawl levers being directly actuated by a single electromagnet.

Japanese laid-open patent publication no. 54-16228 discloses a printer mechanism having fewer electromagnets than type rings. According to this publication, in order for a trigger lever to engage a ratchet wheel disposed on the side of a type ring to stop the rotation of the type ring, the trigger lever must be driven by an armature lever and will thereafter rotate due to inertial forces. When the trigger lever is subjected to disturbances such as variations in frictional loads on the trigger lever, the speed of rotation thereof varies resulting in the possibility of causing printer malfunction such as erroneous selection of a type element disposed on the type ring.

When a second type ring completes a first revolution and is about to make a second revolution, a second trigger lever goes over and beyond a stop on the type ring. In this regard, a cam for controlling the position of the trigger lever has three steps having different diameters. Due to mechanism limitations, however, such diameters cannot be increased with the result that a required degree of dimensional accuracy of the cam cannot be maintained, and the operation of the cam is rendered complex. A spring stopper must be displaced by the cam, and wear on the cam due to frictional contact with the spring stopper is significant. The armature lever is brought to a standby position when held against the spring stopper. A slight deformation of the spring stopper would vary the gap between the armature lever and the attracting portion of the electromagnet, a condition which would render electromagnet performance unstable and cause malfunction of the printer.

When selecting a first type ring, two trigger levers are required to be driven by the electromagnet. The second type ring can be selected by driving a single trigger lever when the first type ring has been selected, and by driving two trigger levers when the first type ring has not been selected. When the two trigger levers are driven, due to frictional contact with the stop on the type ring, the electromagnet is subjected to an increased load which tends to vary greatly. An attempt to construct an electromagnet having a capacity large enough to bear the required load would require an increased expenditure of cost and result in design problems. Accordingly, a printer which requires a single electromagnet which controls a single lever which operates at least two type rings, which is efficient and stable in operation and which avoids the deficiencies of the prior art, is desired.

SUMMARY OF THE INVENTION

Generally speaking, in accordance with the present invention, a printer for printing rows of characters on a recording medium, is provided. The printer includes at least first and second type rings having types or characters disposed on the periphery thereof. The type rings are disposed on a drive shaft which selectively rotates the type rings from a reset or rest position to a print position where a selected type is in position for printing on the recording medium. A ratchet wheel is disposed on the side of each type ring. First and second selection pawls are pivotally supported on a shaft spaced from the drive shaft. The first and second pawls are in alignment with the respective ratchet wheels on the first and second type rings. A control bar moves the first selection pawl into engagement with the ratchet wheel on the first type ring to prevent rotation thereof. A lever pivotally supported on the shaft under the action of an elctromagnet selectively moves the first and second selection pawls into engagement with the ratchet wheels on the first and second type rings to stop the rotation thereof when in a print position.

While the first type ring is held in its reset position by the first selection pawl, the second type ring is rotated to a print position. The electromagnet selectively actuates the lever which in turn moves the second selection pawl into engagement with the ratchet wheel on the second type ring. The control bar then releases the first selection pawl from the ratchet wheel on the first type ring. The first type ring is then rotated to a print position. The electromagnet reactuates the lever which then moves the first selection pawl into engagement with the ratchet wheel on the first type ring to stop the rotation thereof.

A positioning member acts to position the first and second selection pawls out of engagement with the type rings and also acts to hold the selection pawls engaged with the type rings when the selection pawls are moved into engagement therewith. In a preferred embodiment, a plurality of type rings are provided on the drive shaft with a corresponding selection pawl being provided on the pawl shaft. Each adjacent pair of selection pawls are controlled by a single lever and electromagnet.

Accordingly, it is an object of the present invention to provide an improved printer.

Another object of the present invention is to provide an improved small-sized printer which is efficient and stable in operation and less costly to manufacture.

A further object of the present invention is to provide a small-sized printer having a plurality of type rings, the printer being capable of controlling at least two type rings with a single lever controlled by an electromagnet which is reliable and stable in operation.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
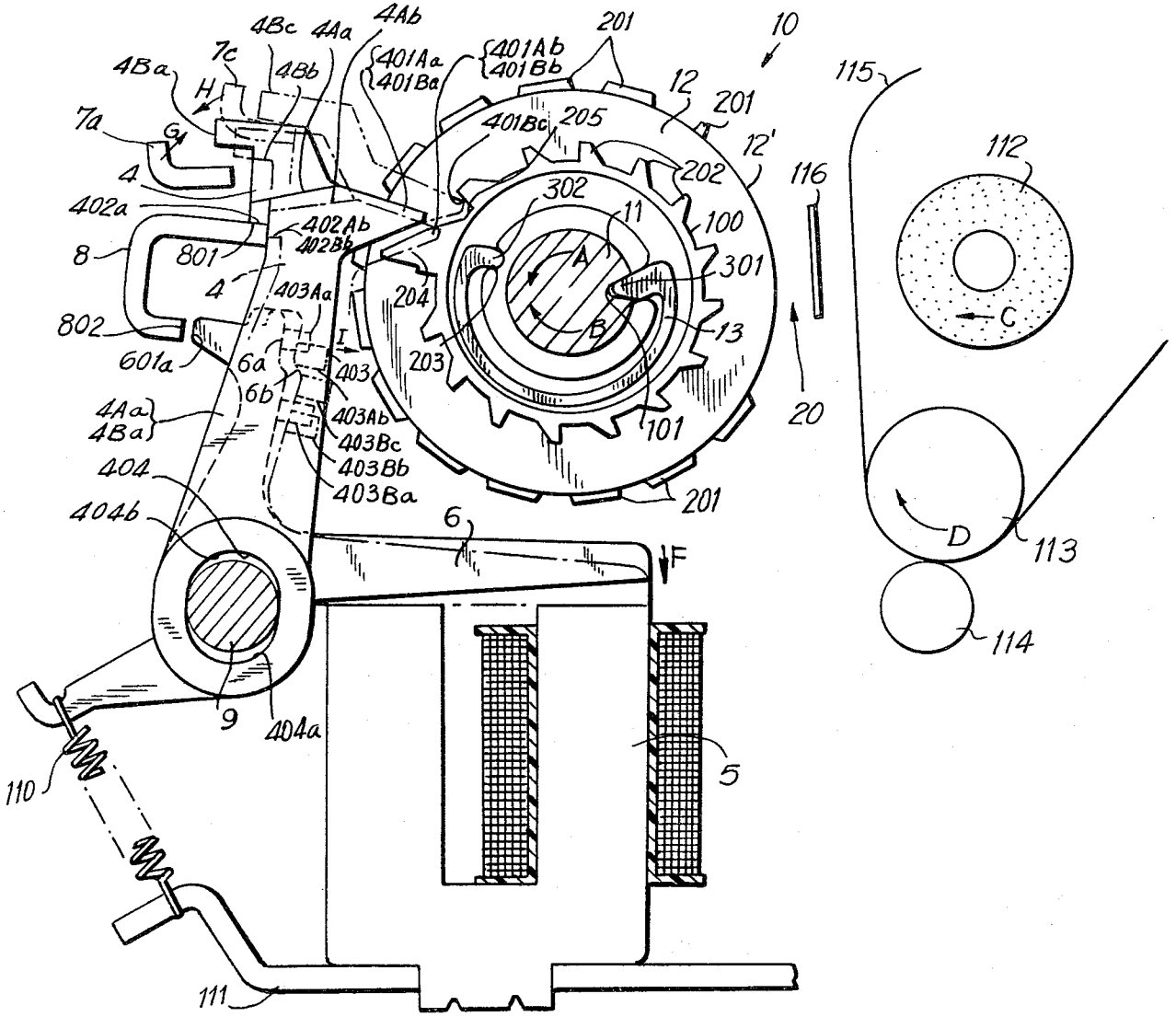
FIG. 1 is a side elevational view of a small-sized printer constructed in accordance with a preferred embodiment of the present invention with changes in position of various parts of the printer being shown in phantom lines.
Figure 2:
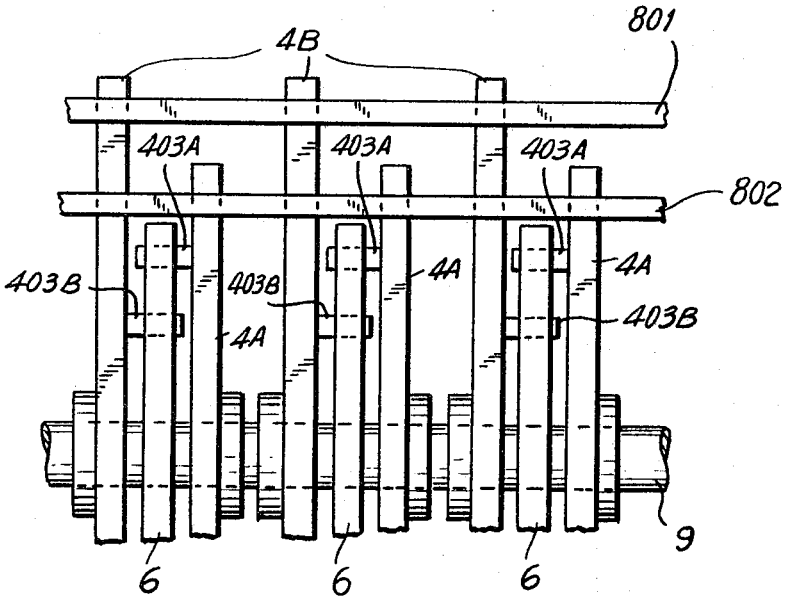
FIG. 2 is fragmentary front elevational view of selected portions of the selector mechanism of the printer depicted in FIG. 1.
Figure 3:
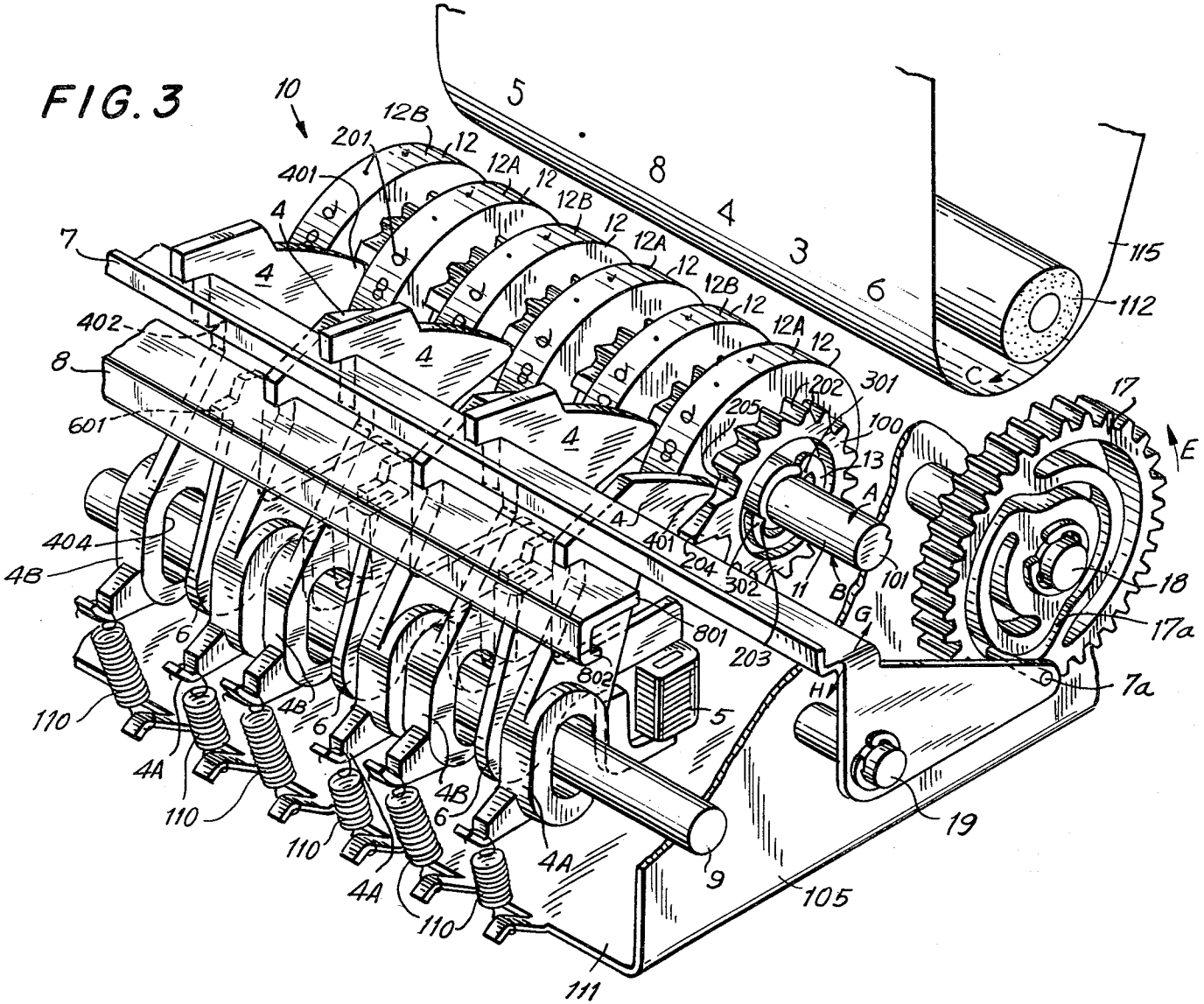
FIG. 3 is a perspective view of the small-sized printer depicted in FIG. 1.

Referring to FIGS. 1 through 3, a printer, generally indicated at 10 includes a type ring shaft 11 having an axial groove 101 formed therein. Type ring shaft 11 supports a plurality of character wheels or type rings 12 each having type elements or types 201 peripherally disposed therearound on the outer surface 12' thereof. A ratchet wheel 100 is secured to one side of each type ring 12 for rotation therewith. Each ratchet wheel 100 has selection teeth 202 which correspond in position to type elements 201 on type rings 12, a slot 203, a projection tooth 204 and a recess 205. A C-shaped type ring spring 13 for each ratchet wheel 100 has a first projecting end 301 received in axial groove 101 in type ring shaft 11 and a second projecting end 302 fitted in slot 203. Type ring spring 13, as it is installed in position, is rendered resilient.

A selection pawl 4 is disposed in alignment with the ratchet wheel 100 for each type ring 12. Each selection pawl 4 has a distal end 401 engageable with selection teeth 202 on its associated ratchet wheel 100 for selecting and holding a desired type element 201 on type ring 12 in a print position indicated at 20. Each selection pawl 4 has a step 402, a projection 403, and an oblong opening 404. Selection pawls 4 include odd-numbered selection pawls 4A in odd-numbered positions and even-numbered selection pawls 4B in even-numbered positions. The suffix A will hereinafter be used to denote odd-numbered type positions, and the suffix B will denote even-numbered type positions. These suffixes will be used only when they are required for specific identification of parts.

The odd-numbered selection pawls 4A and the even-numbered selection pawls 4B are different in shape from each other, as depicted. As described below, the even-numbered selection pawls 4B serve to fit in recesses 205 in the even-numbered type rings 12B for locking the latter against rotation. The number of type rings 12 and selection pawls 4 correspond to the number of type positions. A plurality of V-shaped attractable levers 6 are attractable by electromagnets 5 in the direction of arrow F into engagement with projections 403 on selection pawls 4 to drive selection pawls 4 in the direction of arrow I so as to engage selection teeth 202 on type rings 12, each of the attractable levers 6 having a protrusion 601. A combination of one electromagnet 5 and one attractable lever 6 is provided for every two type positions and selection pawls 4, and therefore the total number of such combinations is half the number of present type positions.

A selection pawl control lever 7 is swingably supported on a shaft 19 fixed to printer frame 105. Selection pawl control lever 7 is angularly movable in the direction of arrow G to actuate the even-numbered selection pawls 4B into engagement with recesses 205 in the even-numbered type rings 12B for locking even-numbered type rings 12B against rotation in the position shown by the phantom double dot-dash lines in FIG. 1 and indicated by the added suffixes c, i.e. 7c and 4Bc.

A cam gear 17 is rotatably journalled on a shaft 18 secured to frame 105. Cam gear 17 includes a cam groove 17a which receives a cam pin 7a on selection pawl control lever 7. Cam gear 17 makes one revolution in the direction of arrow E for each printing cycle for actuating selection pawl control lever 7 through the cooperation of cam groove 17a and cam pin 7a. A positioning plate 8 is secured to frame 105 and has a positioning edge 801 and an abutment edge 802. By engagement of steps 402 of selection pawls 4 with positioning edge 801, selection pawls 4 can be brought to the position shown by the solid lines in FIG. 1, which will hereinafter be referred to as a "standby position" identified by a suffix a, or to the position shown by the phantom dot-dash lines in FIG. 1, which will hereinafter be referred to as a "selection position" identified by a suffix b. Protrusions 601 of attractable plates 6 are engaged against abutment edge 802 on postioning plate 8.

Selection pawls 4 and attractable levers 6 are angularly movably supported on a selection pawl shaft 9 fixed to frame 105, and are arranged in an array as shown in FIG. 2. Selection pawls 4 are normally urged by selection pawl springs 110 in a downward and counterclockwise direction about selection pawl shaft 9, as illustrated in FIG. 1. Electromagnets 5 and selection pawl springs 110 are attached to an electromagnet attachment plate 111 which is secured to frame 105. A printing platen 112 serves to press a printing sheet 115 and an ink ribbon 116 against each type element 201 rotated to print position 20 for printing desired numerals, letters, and symbols on printing sheet 115. Printing sheet 115 can be intermittently fed along in predetermined increments by a paper feed roller 113 when the latter rotates stepwise in the direction of arrow D. Printing sheet 115 as it is fed by the paper feed roller 113, is pressed against the latter by a paper presser roller 114.

Operation of printer 10 will now be described. For selecting desired type elements 201 for printing, a printing command is issued to energize a motor (not shown) to drive a system of drive wheels (not shown). Cam gear 17, which is in such a drive wheel system, is rotated to cause its cam groove to angularly move selection pawl control lever 7 in the direction of arrow G from the position indicated by 7a to the position indicated by 7c. The even-numbered selection pawls 4B are caused by selection pawl control lever 7 to move from the position 4Ba to position 4Bb, in which distal ends 401B thereof are engaged in recesses 205 in the even-numbered type rings 12B to prevent them from rotating. At this time, selection pawls 4B can be moved to the locking position "c" with the bottom portion 404a of oblong opening 404 in selection pawls 4B being out of abutment against selection pawl shaft 9. FIG. 3 shows the parts as brought to positions 7c and 4Bc. When positioned as illustrated in FIG. 3, only the even-numbered type rings 12B are locked against rotation, and the odd-numbered type rings 12A are freely rotatable.

Type ring shaft 11 now starts to rotate in the direction of arrow A. However, the even-numbered type rings 12B are prevented from rotation by the even-numbered selection pawls 4B being engaged therewith. Conversely, the odd-numbered type rings 12A are allowed to rotate with type ring shaft 11 due to frictional forces exerted by springs 13 with the ends 301 thereof engaged in groove 101 in type ring shaft 11. Type ring shaft 11 is coupled to a detector (not shown) for detecting the position of type elements 201. The detector generates timing pulses upon rotation of the type ring shaft 11. When a desired type element 201 arrives at a position immediately before printing position 20, electromagnet 5 is energized (at f in FIG. 4) in synchronization with a timing pulse (FIG. 4) generated to attract attractable lever 6 in the direction of arrow F. At this time, the attractable levers 6 thus actuated engage projections 403A of the odd-numbered selection pawls 4A to move the latter from the position designated by 4Aa to the position designated as 4Ab. The distal ends 401A are now brought into engagement with those of the selection teeth 202 which correspond to the desired type elements 201.

In this position, the even-numbered selection pawls 4B have already been displaced to the position 4Bc by selection pawl control lever 7 with projections 403B in position 403Bc. Thus, attractable levers 6 engage projections 403A only of the odd-numbered selection pawls 4A. Steps 402Ab of selection pawls 4Ab, as actuated, are held in abutment against the positioning edge 801 of positioning plate 8 as shown by the phantom dot-dash line in FIG. 1, with the upper portion 404*b* of the oblong openings 404 being held against the selection pawl shaft 9, so that selection pawls 4A are located in the position indicated by the suffix b, i.e. 4Ab, against counterclockwise rotation and downward movement. Desired type elements in the odd-numbered type positions are selected in the manner as described above while type ring shaft 11 makes substantially one revolution.

For those odd-numbered type positions in which no type element 201 is to be selected, selection pawls 4A are engaged in the last teeth 202 before projection 204. At this time, electromagnets 5 are energized in synchronization with the fourteenth timing pulse as shown at g in FIG. 4. The last teeth 202 correspond to positions free of type elements 201, and hence no printing results from engagement with selection pawls 4A. With the odd-numbered selection pawls 4A all brought to the selection positions b, only the even-numbered selection pawls 4B are actuated by attractable plates 6 upon energization of the electromagnets 5 during a process for selecting type elements 201 in the even-numbered type positions. Therefore, each electromagnet 5 only actuates one attractable plate 6 and one selection pawl 4 at a time.

Figure 4:
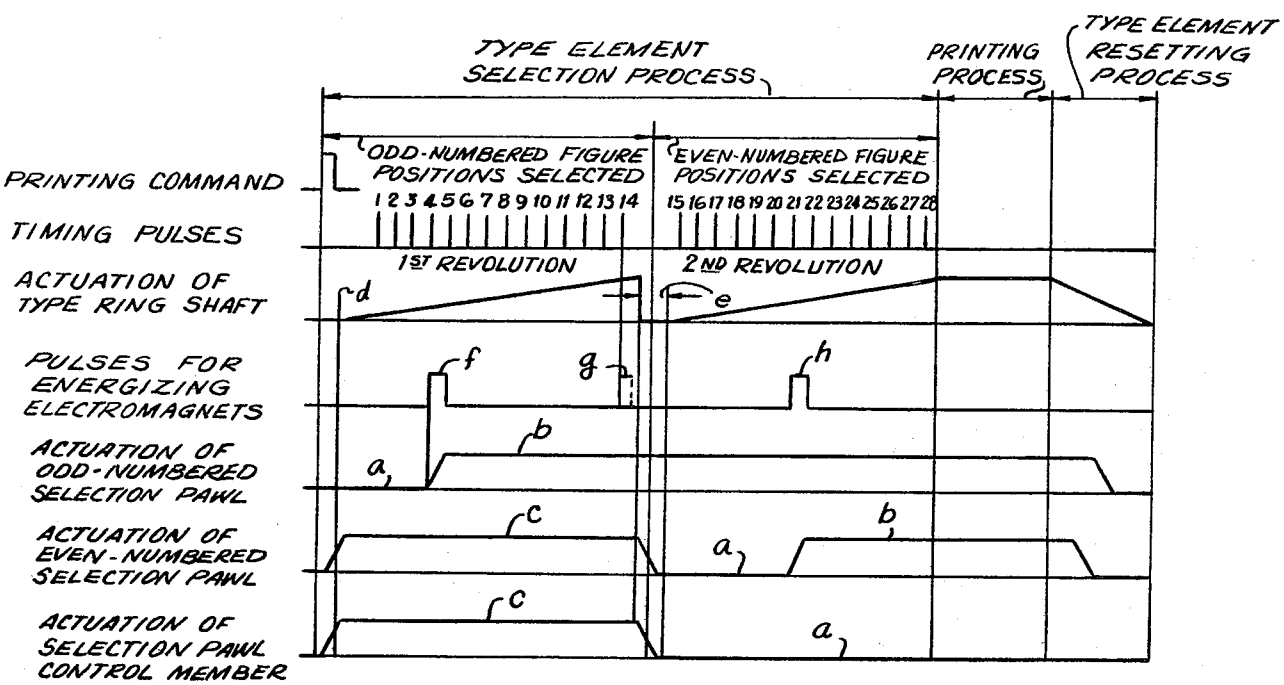
FIG. 4 is a timing chart illustrating the operation and actuation of various parts of the small-sized printer of the present invention.

After the type ring shaft 11 has made substantially one revolution to complete the process for selecting type elements in the odd-numbered type positions, the projecting ends 301 of springs 13 attached to the even-numbered type rings 12B drop again into axial groove 101 in type ring shaft 11, whereupon type ring shaft 11 temporarily stops during an interval e shown in FIG. 4. During this interval e, selection pawl control lever 7 is caused by cam groove 17*a* in the cam gear 17 to return from the position 7*c* to the position 7*a* on angular movement in the direction of arrow H.

On the returning movement of selection pawl control lever 7, the even-numbered selection pawls 4B also return from the position 4Bc to the position 4Ba under the resiliency of selection pawl springs 110. It is necessary at this time that selection pawl control lever 7 return at a slower speed than the speed at which the even-numbered selection pawls 4B return under the force of the selection pawl springs 110. Without such speed setting, selection pawl control lever 7 would go faster ahead of the even-numbered selection pawls 4B, which could then move from the position 4Bc to the position 4Bb without reaching the position 4Ba, a condition that would cause malfunction of printer 10. Selection pawl control lever 7 is caused to return while type ring shaft 11 is held at rest.

When type ring shaft 11 starts rotating again in the direction of arrow A after selection pawl control lever 7 has returned to the position 7*a*, the even-numbered type wheels 12B start to rotate with type ring shaft 11 under the frictional forces with which the projecting ends 301 of springs 13 are engaged in groove 101 in type ring shaft 11. Since the odd-numbered type rings 12A have already been locked by the odd-numbered selection pawls 4A against rotation, the desired type elements 201 on the odd-numbered type rings 12A are transversely aligned in printing position 20. Desired type elements 201 on the even-numbered type rings 12B are selected in the same manner as that in which the desired type elements 201 on the odd-numbered type rings 12A are selected during the first revolution of the type ring shaft 11.

Electromagnets 5 will not be energized for those even-numbered positions in which no type element is to be selected, a procedure which is different from that for the odd-numbered positions. Electromagnets 5 may instead be energized to lock even-numbered type rings 12B in the same way as when selecting odd-numbered type elements as this causes no functional problems. However, even when electromagnets 5 are kept deenergized, projections 204 of even-numbered type rings 12B are held against the distal ends 401*a* of even-numbered selection pawls 4B, and the even-numbered type rings 12B are locked in this position. As this position substantially coincides with the position in which the odd-numbered type rings 12A having no type element selected are locked, no printing can be effected and energy can be conserved as compared with the process in which electromagnets 5 are energized. When type ring shaft 11 is brought to a stop after it has made substantially two revolutions, all of the desired type elements 201 are selected and locked in the printing position. The overall procedure for selecting type elements is now completed.

Printing platen 112 is then caused to move in the direction of arrow C to press printing sheet 115 and ink ribbon 116 against the selected type elements 201, whereupon desired characters are printed on printing sheet 115. During this printing process, type ring shaft 11 is held at rest.

A process for resetting the type elements will now be described. During this type element resetting process, the type ring shaft 11 is caused to rotate about its own axis in the direction of arrow B. Type ring shaft 11 rotates as groove 101 successively receives the projecting ends 301 of springs 13 on type rings 12, whereupon the latter start rotating in succession in the direction of arrow B. At the same time, the distal ends 401*b* of selection pawls 4*b* as disposed in the selection position b are lifted by the slanted surfaces of teeth 202 on the ratchet wheels 100 while type rings 12 rotate in the direction of arrow B. Selection pawls 4 are now reset to the standby position a. All of the type rings 12 and selection pawls 4 are reset while type ring shaft 11 makes substantially one revolution. Projections 204 on the type rings 12 engage selection pawls 4 to lock type rings 12 so that type rings 12 will not rotate due to inertia after type ring shaft 11 has made substantially one revolution in the direction of arrow B. Projections 204 also serve to prevent selection pawls 4 from being brought to the selection position b due to vibrations or other distrubances imposed while printer 10 is not being operated. One cycle of the printing operation is completed when the process for resetting the type elements is finished.

Complicated movements of type ring shaft 11, such as rotation in one directon and the opposite direction with intermediate stopping, can easily be effected by incorporating intermittent motion gears and the like into the system of drive wheels for driving type ring shaft 11.

With the arrangement of the present invention, selection of type rings in two type positions, that is, an odd-numbered type ring 12A and an even-numbered type ring 12B can be carried out by a single electromagnet 5 during the process for selecting type elements. Therefore, the number of electromagnets 5 that are expensive to construct can be reduced to half, and the number of parts required to energize electromagnets 5 can also be reduced to half, with the result that the printer of the invention is much less costly to construct. Type ring shaft 11 is rotated for substantially two revolutions during the process for selecting type elements 201. More specifically, the odd-numbered type elements 201 are selected during the first revolution of type ring shaft 11, and the even-numbered type elements 201 are selected during the second revolution of type ring shaft 11 under the control of selection pawl control lever 7 which drives the even-numbered selection pawls 14B and locks the even-numbered type rings 12B. Selection pawl control lever 7 moves forward when the type ring shaft 11 is about to rotate (at d in FIG. 4), and moves rearward when type ring shaft 11 is held temporarily at rest after it has made the first revolution and before it makes the second revolution (during the interval e in FIG. 4). Therefore, selection pawl control lever 7 makes a simple one reciprocal movement in one cycle of the printing operation.

Cam gear 17 for actuating selection pawl control lever 7 can be rotated in a large stroke as cam gear 17 is attached to frame 105 on its exterior side. Thus, cam gear 17 can be easily and accurately maintained. Selection pawls 4 can be actuated by attractable plates 6 as they are attracted by electromagnets 5 until the distal ends 401 of selection pawls 4 are moved into the path of movement of selection teeth 202 on ratchet wheel 101 and locked by selection teeth 202. Type rings 12 can be positively locked in position, and, hence, are less susceptible to malfunction due to frictional forces exerted thereon or other such disturbances.

The standby position of attractable plates 6 is determined when protrusions 601 of attractable plates 6 are held against the abutment edge 802 of positioning plate 8. Attractable plates 6 cannot be moved away from electromagnets 5 beyond that position, so that the force with which electromagnets 5 attract attractable plates 6 is rendered stable at all times. Each of electromagnets 5 actuates a single selection pawl 4 at any point of time, and hence is subject to a small and constant load. The electromagnets 5 used can be designed so that they have good efficiency and are of a relatively small capacity, and hence can be manufactured less costly. There is thus provided a small-sized printer which is inexpensive to construct, simple and stable in operation, and reliable in use.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printer comprising at least first and second type rings having types disposed on the periphery thereof, rotation means for rotating said first and second type rings from a reset position to a print position, first and second ratchet wheels disposed on the side of said first and second type rings, respectively, a shaft spaced from said first and second type rings, first and second pawl means pivotally supported on said shaft for stopping the rotation of said first and second type rings, respectively, control means associated with said first pawl means for moving said first pawl means into engagement with said first ratchet wheel when said first type ring is in its reset position to prevent rotation thereof, said rotation means rotating said second type ring into a print position while said first type ring is held in its reset position by said first pawl means, lever means associated with said first and second pawl means for selectively moving said first and second pawl means into engagement with said first and second ratchet wheels, respectively, an electromagnet means for actuating said lever means, positioning means for positioning said second pawl means out of engagement with said second ratchet wheel, said electromagnet means selectively actuating said lever means when said first pawl means is engaged with said first ratchet wheel when in its reset position, said actuated lever means moving said second pawl means into engagement with said second ratchet wheel to stop the rotation thereof when in a print position, said electromagnet means releasing said lever means after said second pawl means is engaged with said second ratchet wheel, said positioning means holding said second pawl means in engagement with said second ratchet wheel, said control means permitting said first pawl means to release from said first ratchet wheel when said second pawl means is engaged with said second ratchet wheel, said rotation means rotating said first type ring to a print position, said electromagnet means selectively reactuating said lever means, said reactuated lever means moving said first pawl means into engagement with said first ratchet wheel to stop the rotation of said first type ring when rotated to a print position, said lever means being pivotally supported on said shaft, said lever means being disposed intermediate said first and second pawl means on said shaft, said first and second pawl means each including a projection which extends into the path of pivot of said lever means, said lever means selectively contacting said projections on said first and second pawl means when said lever means is actuated by said electromagnet means.

2. The printer as claimed in claim 1, wherein said first and second pawl means each include an oblong opening, said shaft extending through said respective oblong openings of said first and second pawl means.

3. The printer as claimed in claim 2, wherein said first and second pawl means are radially and pivotally movable with respect to said shaft.

4. The printer as claimed in claim 1, 2 or 3, wherein said control means includes cam means for actuating said control means.

5. The printer as claimed in claim 4, wherein said cam means includes a gear means having a cam groove formed therein rotatably supported on said printer, said control means including a control bar having a cam pin engaged in said cam groove.

6. The printer as claimed in claim 1, wherein said first and second pawl means each include biasing means for biasing said first and second pawl means away from said first and second type rings.

7. The printer as claimed in claim 6, wherein said positioning means includes a positioning member having a first edge, said first and second pawl means being biased against said first edge by said respective biasing means.

8. The printer as claimed in claim 7, wherein said positioning member includes a second edge, said lever means resting against said second edge when not actuated by said electromagnet means.

9. The printer as claimed in claim 1, wherein said first and second pawl means each include biasing means for biasing said first and second pawl means away from said first and second type rings.

10. The printer as claimed in claim 9, wherein said positioning means includes a positioning member having a first edge, said first and second pawl means being biased against said first edge by said respective biasing means.

11. The printer as claimed in claim 10, wherein said positioning member includes a second edge, said lever means resting against said second edge when not actuated by said electromagnet means.

12. The printer as claimed in claims 2 or 3, further comprising a platen means for pressing a recording medium against said types when in a print position.

13. The printer as claimed in claim 1, further comprising a platen means for pressing a recording medium against said types when in a print position.

14. The printer as claimed in claim 1, wherein said control means includes cam means for actuating said control means.

15. The printer as claimed in claim 14, wherein said cam means includes a gear means having a cam groove formed therein rotatably supported on said printer, said control means including a control bar having a cam pin engaged in said cam groove.

16. The printer as claimed in claim 1, wherein said rotation means includes a rotatable drive shaft, said first and second type rings being disposed on said drive shaft, and coupling means for coupling said first and second type rings to said drive shaft for selective rotation therewith.

17. The printer as claimed in claim 16, wherein said coupling means includes a spring means coupled to each said first and second ratchet wheels for engaging said drive shaft.

18. The printer as claimed in claim 17, wherein said first ratchet wheel includes a recess, said control means moving said first pawl means into said recess when said first type ring is in said reset position.

19. The printer as claimed in claim 18, wherein said drive shaft includes an elongated axial slot, said spring means including a first end which engages said slot.

* * * * *